United States Patent [19]

Bosch et al.

[11] 3,972,659

[45] Aug. 3, 1976

[54] PLANETARY GEAR MOTOR HAVING FIXED AND ROTATING SUN GEARS

[75] Inventors: Paul Bosch, Ludwigsburg; Egon Tittmann, Leonberg, both of Germany

[73] Assignee: Robert Bosch G.m.b.H., Stuttgart, Germany

[22] Filed: Sept. 10, 1974

[21] Appl. No.: 504,756

[30] Foreign Application Priority Data

Sept. 13, 1973 Germany ..... 2346104

[52] U.S. Cl. ..... 418/60; 418/133; 418/151; 74/802

[51] Int. Cl.[2] ..... F01C 1/08; F01C 19/08; F01C 21/00; F03C 3/00

[58] Field of Search ..... 418/54, 58, 60, 151, 418/131–133; 74/802

[56] References Cited

UNITED STATES PATENTS

| | | | |
|---|---|---|---|
| 1,575,987 | 3/1926 | Gilman | 418/60 |
| 1,689,587 | 10/1928 | Holmes | 418/60 |
| 2,240,874 | 5/1941 | Thomas et al. | 418/60 |
| 2,500,458 | 3/1950 | Hinckley | 418/151 |
| 3,137,238 | 6/1964 | Gordon | 418/132 |

*Primary Examiner*—John J. Vrablik
*Attorney, Agent, or Firm*—Michael J. Striker

[57] ABSTRACT

An external gear type fluid power motor wherein a rotor receives two groups of gears each including a sun gear and one or more planet pinions. The sun gears are coaxial with each other; one thereof is fixed and the other drives an output shaft. Each planet pinion of one group is integral with a planet pinion of the other group or is nonrotatably coupled to it by an oldham coupling. Pressurized fluid is admitted by way of passages machined into a supporting member which is rigid with the housing and rotatably supports one end of the rotor. Such fluid flows through passages in the rotor and rotates the planet pinion or pinions of one or both groups whereby the planet pinion or pinions of one group roll along the fixed sun gear to drive the rotor and to cause the planet pinion or pinions of the other group to roll about the other sun gear which thereby rotates the output shaft. The stubs of the gears can be mounted in discrete bearing members or in covers which form part of the rotor.

20 Claims, 4 Drawing Figures

PLANETARY GEAR MOTOR HAVING FIXED AND ROTATING SUN GEARS

BACKGROUND OF THE INVENTION

The present invention relates to fluid power motors in general, and more particularly to improvements in gear type motors. Still more particularly, the invention relates to external type motors.

Heretofore known fluid power motors which utilize external spur, herringbone or helical gears are of simple construction and can be manufactured at a relatively low cost. However, they exhibit the drawback that the RPM of the output member is invariably high. This severely limits their utility, i.e., such motors cannot be employed for transmission of high torque at relatively low speeds because they would have to be combined with complex reducing gears which would contribute excessively to the overall cost of the prime mover assembly.

It is also known to provide a gear type fluid power motor with an internal gear and an external gear which rolls along the teeth of the internal gear and thereby performs an orbital movement about the axis of the output shaft. Such motors can operate at low speeds but their cost is very high, especially at a high output torque. Moreover, the regulation of fluid flow into and from such motors is quite complex which results in a significant increase of the initial and maintenance cost.

SUMMARY OF THE INVENTION

An object of the invention is to provide a novel and improved gear type fluid power motor which can produce a high output torque at relatively low speeds and is simpler, more compact and less expensive than heretofore known motors with similar characteristics.

Another object of the invention is to provide a gear type fluid power motor which can furnish high output torque at a low RPM in spite of the fact that it does not have any internal gears.

A further object of the invention is to provide a novel fluid flow regulating system for use in the improved gear type motor.

An additional object of the invention is to provide an external gear type fluid power motor which is just as versatile as heretofore known motors but is nevertheless capable of furnishing high torque at speeds which are much lower than those that can be achieved with conventional external gear type motors.

Still another object of the invention is to provide novel and improved combinations of external gears for use in a gear type fluid power motor.

The invention is embodied in a gear type fluid power motor which comprises a housing, a rotor in the housing; an output member rotatably mounted in the housing; a plurality of groups of mating external gears in the housing, and bearing means provided in the housing for the external gears. In accordance with a feature of the invention, the external gears include a first group having a fixed first sun gear which is coaxial with the rotor and at least one first planet gear which meshes with the sun gear and is rotatable in the rotor whereby the latter rotates when the planet gear rolls along the sun gear. A second group of external gears includes a rotary second sun gear which can transmit torque to the output member and at least one second planet gear which is rotatable in the rotor with the first planet gear and meshes with the second sun gear. The first planet gear may be made integral with the second planet gear or it may be connected to the second planet gear by an oldham coupling. The admission of pressurized hydraulic fluid against the teeth of one or both planet gears takes place by way of passages which are machined into a supporting member for the rotor and into the rotor. Spent fluid is evacuated by way of passages in the rotor and supporting member.

The novel features which are considered as characteristic of the invention are set forth in particular in the appended claims. The improved motor itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
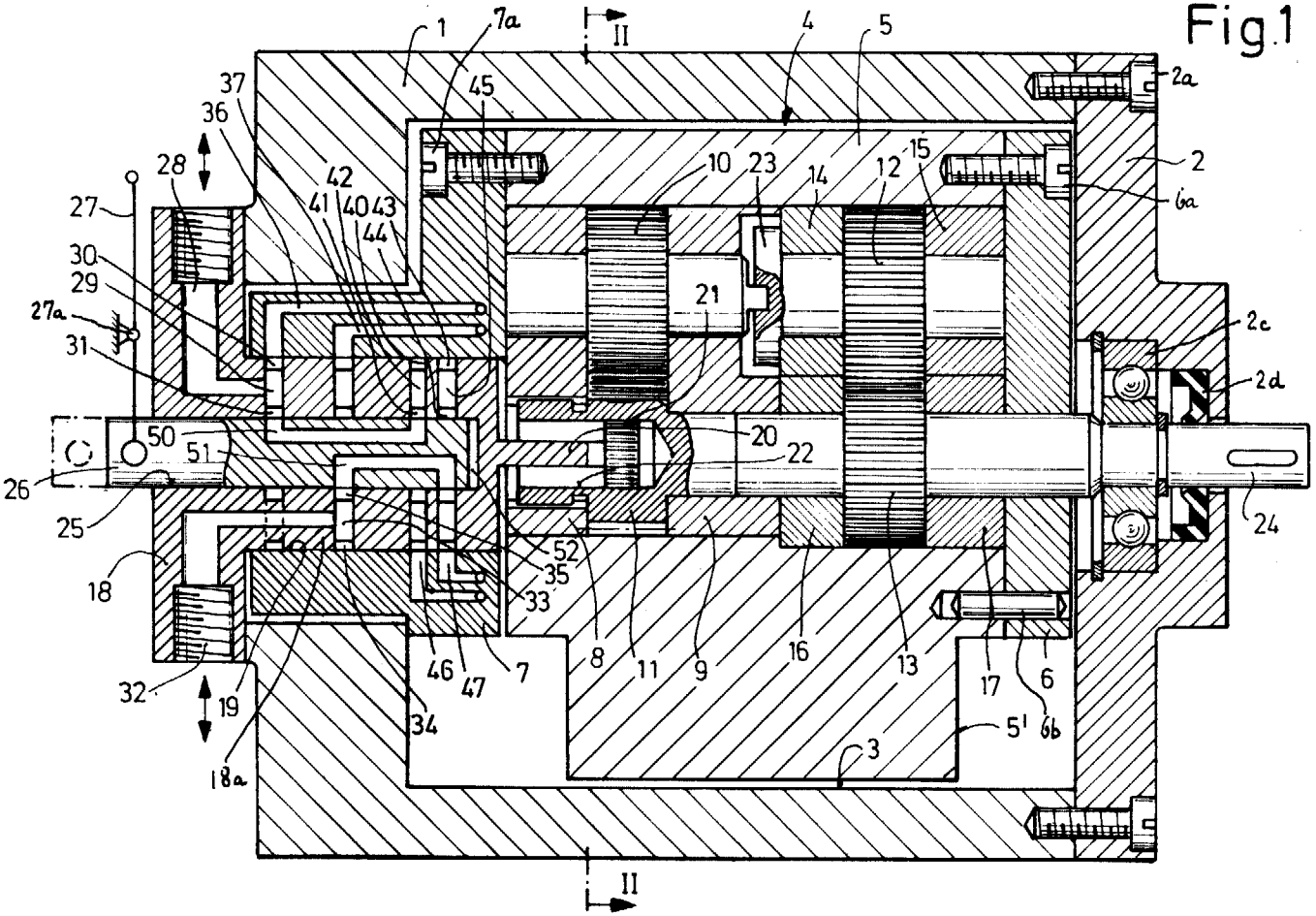
FIG. 1 is a longitudinal sectional view of a gear type fluid power motor which embodies one form of the invention.
Figure 2:
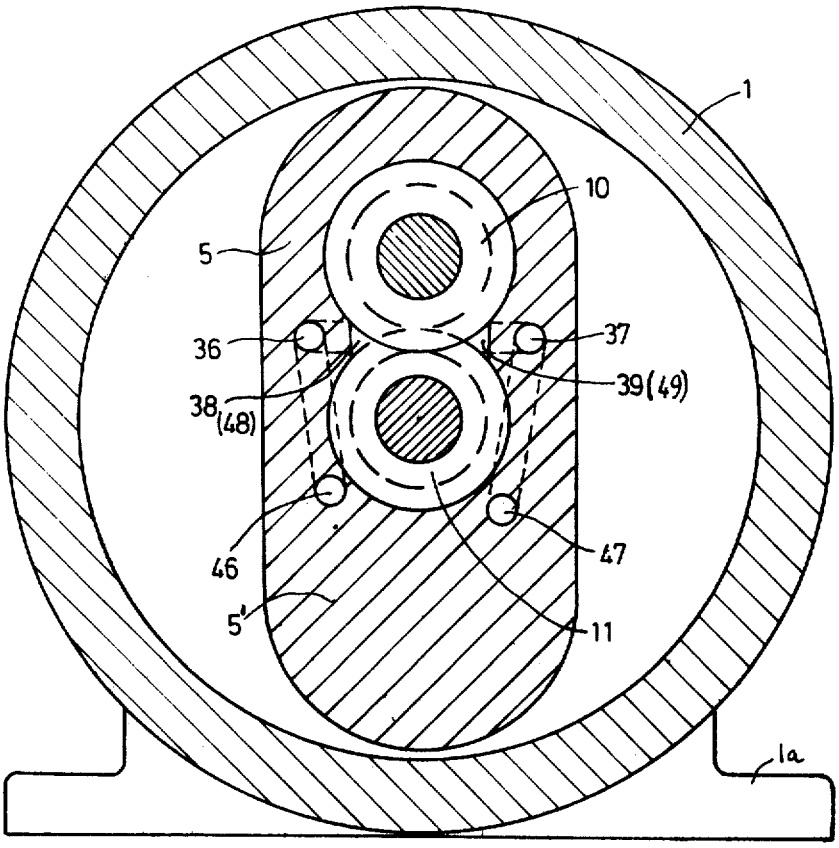
FIG. 2 is a sectional view as seen in the direction of arrows from the line II—II of FIG. 1.

The gear type fluid power motor which is shown in FIGS. 1 and 2 comprises a housing having a base or leg 1*a* and including a cupped main portion 1 and a cover or end wall 2 which is separably secured to the main portion 1 by screws 2*a* or analogous fasteners. The internal space of the housing 1, 2 is shown at 3; this space receives a hollow rotor 4 having an oval cross-sectional outline (see FIG. 2) and including a receiving portion or member 5 for two sets or groups of gears 10, 11 and 12, 13 and a second portion or counterweight 5' which balances the mass of the receiving member 5 and of the parts (see 10, 12, 14, 15) mounted therein when the rotor 4 is caused to turn about the axis of an output shaft 24. The gear 10 is a planet gear or pinion and the rotor 4 can be said to constitute a carrier for the planet pinion 10. The two open ends of the receiving member 5 are closed by covers or lids 6 and 7 which are secured thereto by screws 6*a*, 7*a* or analogous fasteners. FIG. 1 further shows a guide pin 6*b* which extends into registering bores of the receiving member 5 and cover 6.

The receiving member 5 of the rotor 4 contains two spaced-apart parallel eight-shaped bearing members 8 and 9 which flank the gears 10, 11 of the first group of gears. The two coaxial stubs of the planet pinion 10 are received in the upper openings of the bearing members 8, 9, as viewed in FIG. 1, and the two coaxial stubs of the gear 11 are received in the lower openings of these bearing members. The gears 12, 13 of the second group of gears are mounted in the receiving member 5 behind the gears 10, 11, as considered in the axial direction of the rotor 4 and from the left of FIG. 1. The stubs of the gear 12 are rotatable in two discrete bearing sleeves 14, 15 and the stubs of the gear 13 are rotatable in two additional discrete bearing sleeves 16, 17. It is clear, however, that the stubs of the gears 12, 13 can be mounted in two being members similar to the members 8, 9 and/or that at least one of the bearing members 8,

9 can be replaced by a pair of bearing sleeves similar to the sleeves 14, 16 or 15, 17. The drawing shows different types of bearing members for the sole purpose of indicating that all of the bearing members need not be of identical form.

The end wall of the main portion 1 of the housing (i.e., the left-hand end wall, as viewed in FIG. 1) is rigidly connected with a supporting member 18 a portion of which extends with minimal clearance through a cylindrical bore 19 of the cover 7 of the rotor 4. The supporting member 18 comprises an elongated extension 20 a portion of which is externally splined, as at 21, to mate with an internally splined portion 22 of the gear 11. Thus, the gear 11 is fixedly held against rotation and can be said to constitute the sun gear of a planetary which further includes the planet pinion 10.

The planet pinion 10 is non-rotatably connected with the gear 12 by a conventional oldham coupling including an intermediate disk 23 and serving to cause the gear 12 to orbit about the gear 13 in response to orbiting of planet pinion 10 about the sun gear 11. The sun gear 11 is assumed to be coaxial with the gear 13 and the planet pinion 10 is assumed to be coaxial or substantially coaxial with the gear 12. The right-hand stub of the gear 13, as viewed in FIG. 1, constitutes the aforementioned output shaft 24 which drives a work in response to orbiting of the planet pinion 10 about the sun gear 11. The output shaft 24 is journalled in the aforementioned bearing sleeve 17 as well as in the end wall 2 of the motor housing. FIG. 1 shows an antifriction bearing **2*c* and a packing 2*d*, both mounted in the end wall 2 and surrounding the output shaft 24. It will be seen that one axial end of the rotor 4 is mounted on that portion (20) of the supporting member 18 which extends into the housing 1, 2 (see the bore 19 of the cover 7) and the other end of the rotor 4 is mounted in the end wall 2 of the housing (through the medium of the output shaft 24). The axis of rotation of the rotor 4 coincides with the axis of the output shaft 24.**

The supporting member 18 constitutes the body of a regulating valve and is formed with an axially extending blind bore 25 for a reciprocable valve member 26. The actuating means for shifting the valve member 26 axially between two predetermined end positions (one shown in FIG. 1 by solid lines and the other shown by phantom lines) comprises a lever 27 which is fulcrumed at **27*a* and is articulately connected to the exposed outer end portion of the valve member. The means for admitting and evacuating hydraulic fluid comprises two ports 28, 32 which are machined into the supporting member 18. It is assumed that the port 28 constitutes an inlet for pressurized fluid and the port 32 constitutes an outlet for spent fluid. If the direction of rotation of the output shaft 24 is to be reversed, pressurized fluid is admitted via port 32 and spent fluid is allowed to escape via port 28.**

The inner end of the port 28 communicates with a radially extending bore or channel 29 machined into that (annular) portion **18*a* of the extension 20 which passes through the cover 7. The outer end of the channel 29 communicates with an endless ring-shaped groove 30 which is machined into the peripheral surface of the annular portion 18*a* and the inner end of the channel 29 communicates with an endless ring-shaped groove 31 which is machined into the internal surface of the annular portion 18*a*.**

The inner end of the port 32 communicates with a second radially extending bore or channel 33 which is shown as being located substantially diametrically opposite the channel 29 (but is offset as considered in the axial direction of the output shaft 24) and connects two ring-shaped grooves 34, 35 which are respectively machined into the peripheral and internal surfaces of the annular portion **18*a*. The cover 7 of the rotor 4 has two channels 36, 37 which respectively communicate with the grooves 30, 34 at one end and with openings 38, 39 at the other end. If the port 28 is an inlet for pressurized hydraulic fluid, the channel 36 admits pressurized fluid to the opening 38 and the channel 37 receives spent fluid from the opening 39. Pressurized fluid in the opening 38 exerts pressure against the adjacent tooth or teeth of the planet pinion 10 and causes this pinion to roll about the fixedly mounted sun gear 11 whereby the planet pinion 10 rotates clockwise, as viewed in FIG. 2, and rotates the rotor 4.**

The peripheral surface of the annular portion **18*a* of the extension 20 of supporting member 18 is formed with two additional ring-shaped grooves 40, 43, and the internal surface of the annular portion 18*a* has two additional ring-shaped grooves 41, 44 which respectively register with the grooves 40, 43, as considered radially of the annular portion 18*a*. The latter has a radially extending bore or channel 42 which connects the grooves 40, 41, and a radially extending bore of channel 45 which connects the grooves 43, 44. The valve member 26 has a first bore 50 which connects the grooves 31, 41 when the valve member 26 assumes the end position shown in FIG. 1 by solid lines, and a second bore 51 which then connects the grooves 35, 44. Thus, the port 28 can admit pressurized fluid into the groove 40 and the port 32 communicates with the groove 43 as long as the valve member 26 remains in the solid-line position of FIG. 1. A channel 46 which is machined into the cover 7 and receiving member 5 of the rotor 4 communicates with the groove 40 at one end and with an opening 48 (FIG. 2) at the other end. Analogously, a channel 47 which is machined into the cover 7 and receiving member 5 communicates with the groove 43 at one end and with an opening 49 at the other end. The openings 48, 49 are located at the opposite sides of the locus of engagement between the teeth of gears 12 and 13. These openings are in substantial or exact alignment with the aforementioned openings 38, 39, as considered in the axial direction of the rotor 4.**

The innermost portion of the blind bore 25 in the supporting member 18 constitutes a chamber 52 which is relatively narrow (as considered in the axial direction of the output shaft 24) when the valve member 26 is held in the solid-line position of FIG. 1. When the lever 27 is actuated to shift the valve member 26 to the phantom-line position of FIG. 1, the axial length of the chamber 52 increases so that the latter communicates with the groove 44 as well as with the groove 41, i.e., the chamber 52 receives pressurized fluid from the port 28 (via bore 51 and groove 41 because the bore 51 then connects the groove 31 with the groove 41 and the bore 50 is sealed from the groove 31). The channels 46, 47 then communicate with each other by way of the chamber 52 and are sealed from the ports 28, 32. Consequently, pressurized fluid does not flow from the channel 46 to the opening 48 and the gears 12, 13 are not positively driven by pressurized fluid.

The provision of means for disconnecting the one or the other group of gears from the port which admits pressurized fluid is desirable and advantageous but not essential. Thus, the motor of FIGS. 1 and 2 can be designed in such a way that pressurized fluid always flows only to the opening 38 or 39, only to the opening 48 or 49, or simultaneously to the openings 38, 48 or 39, 49 (always depending on the desired direction of rotation of the output shaft 24).

The gear 13 constitutes a rotary sun gear of a second planetary which drives the output shaft 24, and the gear 12 constitutes a planet pinion or gear of the second planetary. This planet pinion is rotatably mounted in the rotor 4 and rotates with the planet pinion 10; therefore, the rotor 4 is rotated about the axis of the output shaft 24 irrespective of whether pressurized fluid causes the planet pinion 12 to roll along the rotary sun gear 13 or the planet pinion 10 to roll along the fixed sun gear 11.

If the port 28 is an inlet for pressurized fluid and the valve member 26 is held in the solid-line position of FIG. 1, the parts 28, 29, 30, 31, 50, 40, 41, 42 constitute first passages which are provided in the supporting member 18 and serve for admission of pressurized hydraulic fluid, and the parts 32, 33, 34, 35, 51, 43, 44, 45 constitute second passages for evacuation of spent fluid via supporting member 18. The parts 36, 38, 46, 48 constitute third passages which are machined into the rotor 4 and serve to convey pressurized fluid from the first passages to the teeth of planet pinions 10 and 12. The parts 37, 39, 47, 49 constitute fourth passages which are machined into the rotor 4 and serve to convey spent fluid from spaces between the teeth of the planet pinions 10, 12 to the second passages.

The operation:

It is assumed that the port 28 is connected to the outlet of a hydraulic pump and that the port 32 is connected with a tank. It is further assumed that the lever 27 maintains the valve member 26 in the solid-line (right-hand end) position of FIG. 1. Pressurized fluid flows from the port 28 into the channels 29, 42 (into the latter via bore 50), grooves 30, 31, 40, 41 channels 36, 46, and into the openings 38, 48. Spent fluid which flows from the opening 38, through the spaces between the mating teeth of gears 10, 11 and into the opening 39 is returned into the tank via channel 37, grooves 34, 35, channel 33, and port 32. Analogously, spent fluid which flows from the opening 48, through the spaces between the mating teeth of the gears 12, 13 and into the opening 49 is returned to the tank via channel 47, grooves 43, 44, channel 45, bore 51, grooves 34, 35, channel 33 and port 32. Pressurized fluid in the opening 38 causes the planet pinion 10 to roll along the fixedly mounted sun gear 11 and to thus orbit about the axis of the shaft 24. The stubs of the planet pinion 10 cause the rotor 4 to turn about the axis of the output shaft 24 (namely, in a clockwise direction, as viewed in FIG. 2). The planet pinion 12 rotates about its own axis and thereby rolls along the sun gear 13 which is caused to rotate with the ouptut shaft 24 because the transmission ratio of the gears 10, 11 is different from that of the gears 12, 13. The magnitude of torque which is transmitted to the output shaft 24 depends on the total transmission ratio of the two groups of gears, on the pressure of fluid which is admitted via port 28, and on the input volume.

If the valve member 26 is shifted to the phantom-line position of FIG. 1, the flow of fluid to and from the openings 48, 49 is interrupted. As mentioned above, the length of the chamber 52 then increases to such an extent that the grooves 41 and 44 are in direct communication with each other. Consequently, the path for the fluid which would have flown to the opening 48 is short-circuited and the fluid cannot positively move the planet pinion 12 with respect to the sun gear 13. Consequently, and assuming that the rate of fluid inflow via port 28 remains unchanged, the RPM of the output shaft 24 increases but the torque decreases to an extent which is proportional to the ratio of flow of fluid to the openings 38, 48 in the first end position of the valve member 26.

Figure 3:
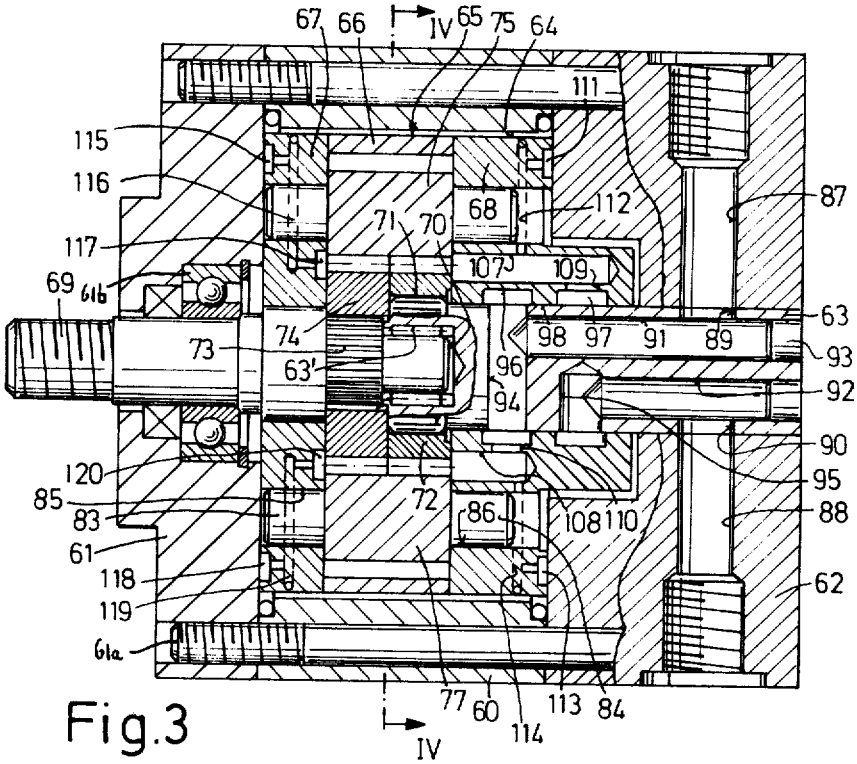
FIG. 3 is a longitudinal sectional view of a second motor.
Figure 4:
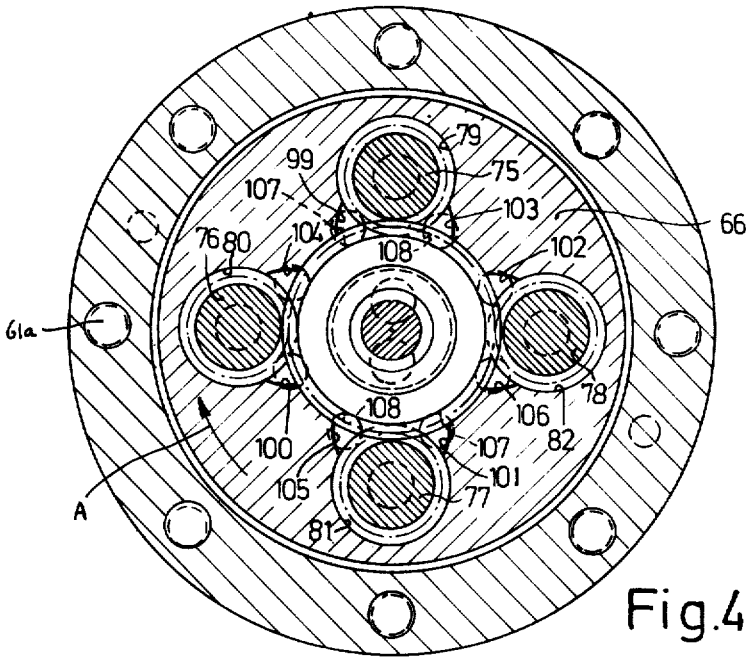
FIG. 4 is a sectional view as seen in the direction of arrows from the line IV—IV of FIG. 3.

FIGS. 3 and 4 show a second gear type fluid power motor which need not be provided with any balancing means for the rotor 65. This motor has a housing including a centrally located tubular main body portion 60 and two end walls 61, 62 which are secured to each other and to the main body portion 60 by elongated bolts **61*a* or the like. The end wall 62 is rigid with a supporting member 63 which extends into the internal space 64 of the housing and into the interior of the rotor 65 which again constitutes a rotary carrier of a planetary transmission. The rotor 65 comprises a centrally located cylindrical receiving portion or member 66 and two covers or lids 67, 68 which are adjacent to the respective open ends of and are secured to the receiving member 66 by screws of the like, not shown. The outer sides of the covers 67, 68 are respectively closely adjacent to the inner sides of the end walls 61, 62** of the housing.

The output shaft 69 of the motor is rotatable in an antifriction bearing **61*b* of the end wall 61 and one of its end portions extends from the housing to drive a work, not shown. The inner end portion of the output shaft 69 extends into a blind bore 63' of and is journalled in the inner end portion 70 of the supporting member 63 in the interior of the receiving member 66. The inner end portion 70 is externally splined, as at 71, and extends into an internally splined sun gear 72 so that the latter is held against rotation with respect to the housing (it will be recalled that the supporting member 63 is rigid with the end wall 62). The output shaft 69 is also formed with an externally splined portion 73 which is adjacent to the open end of the blind bore 63' and extends into an internally splined rotary second sun gear 74. Thus the output shaft 69 and the sun gear 74 rotates as a unit. The gears 72, 74 have a common axis and their combined axial length equals or approximates the axial length of each of four planet pinions or gears 75, 76, 77, 78 which are rotatably mounted in recesses 79, 80, 81 and 82 provided therefor in the receiving member 66 of the rotor 65. The planet pinions 75–78 are equally spaced from each other about the sun gears 72, 74 (see FIG. 4). Each planet pinion has two coaxial stubs 83, 84 which respectively extend into sockets or bores 85, 86 of the covers 67 and 68**.

The right-hand halves of the planet pinions 75–78 (as viewed in FIG. 3) constitute with the fixed sun gear 72 a first group of mating external gears, and the left-hand halves of the planet pinions 75–78 constitute with the rotary sun gear 74 a second group of mating external gears. All of these gears are mounted in the receiving member 66 and the covers 67, 68 constitute bearing members for the stubs of the planet pinions. It will be noted that the planet pinions 75 and 76 are respectively mirror symmetrical to the planet pinions 77 and 78 with respect to the common axis of the sun gears 72, 74.

The end wall 62 of the housing is formed with ports 87, 88 which respectively serve for admission of pressurized hydraulic fluid and for evacuation of spent fluid or vice versa. The inner end portions of these ports respectively communicate with radial bores 89, 90 which are machined into the supporting member 63, and the radial bores 89, 90 respectively communicate with longitudinally extending bores 91, 92 of the supporting member. The left-hand end portions of the bores 91, 92 respectively communicate with radially extending bores 94, 95 of the supporting member 63. The bore 94 is a diametral bore whose ends communicate with a ring-shaped groove 96 in the internal surface of the cover 68. The bore 95 is a blind bore and its outer end communicates with a ring-shaped groove 97 in the internal surface of the cover 68. The outer ends of the bores 91, 92 in the supporting member 63 are sealed by threaded plugs 93 or the like. The aforementioned grooves 96, 97 extend radially outwardly from a cylindrical internal surface 98 of the cover 68. The surface 98 is closely adjacent to the peripheral surface of the adjacent portion of the supporting member 63 so as to reduce the amount of fluid leakage between 63 and 68.

The receiving member 66 is formed with discrete openings 99, 100, 101, 102 for the respective planet pinions 75–78. If the rotor 65 turns clockwise, as viewed in FIG. 4 (see the arrow A), the openings 99–102 admit pressurized fluid. Additional openings 103, 104, 105, 106 are respectively provided in the receiving member 66 for the planet pinions 75–78, and these openings serve for evacuation of spent fluid if the rotor 65 turns clockwise. The openings 103–106 admit pressurized fluid and the openings 99–102 evacuate spent fluid if the rotor 65 is caused to turn counterclockwise, as viewed in FIG. 4. The openings 99–102 communicate with discrete channels 107 and the openings 103–106 communicate with discrete channels 108, all machined into and all extending in parallelism with the axis of the axis of the cover 68. The right-hand ends of the channels 107, as viewed in FIG. 3, communicate with the groove 97 by way of radial bores 109 in the cover 68, and the right-hand ends of the channels 108 communicate with the groove 96 by way of radial bores 10 in the cover 68.

That side or surface of the cover 68 which is adjacent to the end wall 62 of the housing has a recess 111 which is in communication with one of the channels 107 by way of a connecting channel 112. A second recess 113 in the aforementioned side or surface of the cover 68 is in communication with one of the channels 108 by way of a connecting channel 114. That side or surface of the cover 67 which is adjacent to the end wall 61 of the housing has two recesses 115, 118 which are disposed substantially diametrically opposite each other and which respectively communicate with connecting channels 116, 119. The channel 116 further communicates with a recess or cutout 117 machined into that (second) surface or side of the cover 67 which is adjacent to the sun gear 74. The channel 119 further communicates with a recess or cutout 120 in the second surface or side of the cover 67. The recesses 117, 120 communicate with fluid-admitting openings of the motor. When the motor is in use, pressure fields which develop in the region of recesses 111, 113, 115, 118 urge the covers 68, 67 into sealing engagement with the adjacent end faces of the neighboring gears.

Each of the planet pinions 75–78 can be considered as consisting of two planet pinions which cannot rotate relative to each other, one of which meshes with the sun gear 72, and the other of which meshes with the sun gear 74.

If the port 88 is connected with the outlet of a pump, pressurized fluid flows through the bores 90, 92, 95 of the supporting member 63, groove 97, channels 107 and to the respective openings 99–102. The planet pinions 75–78 rotate about their respective axes and thereby roll along the fixedly mounted sun gear 72. The stubs of the planet pinions 75–78 (such stubs are mounted in the covers 67, 68) entrain the rotor or carrier 65 which rotates clockwise, as viewed in FIG. 4. At the same time, the planet pinions 75–78 cause the second sun gear 74 to rotate about its axis and to turn the output shaft 69 by way of the splined portion 73.

The fluid which escapes through the spaces between the mating teeth of the planet pinions 75–78 and sun gears 72, 74 enters the respective openings 103–106 and flows into the port 87 via channels 108, bores 110, groove 96 and bores 94, 91, 89. The direction of rotation of the output shaft 69 is reversed if the outlet of the pump is connected with the port 87.

The covers 67, 68 are pressed against the adjacent end faces of the neighboring gears by the aforementioned pressure fields, e.g., in the region of recesses 115, 117 and 111, 113. One of the fields at the outer side of each cover is a high-pressure field and the other field is a low-pressure field. Such pressure fields compensate for the pressure which is applied to the covers 67, 68 by fluid in areas where the teeth of the planet pinions 75–78 mate with the teeth of the sun gears 72, 74.

The number of teeth on the rotating sun gear 74 is less (at least by one) than the number of teeth on the fixedly mounted sun gear 72. This insures that the sun gear 74 rotates counter to the direction of rotation of planet pinions 75–78. The number of planet pinions equals the difference between the number of teeth on the sun gear 72 and the number of teeth on the sun gear 74. Thus, in the embodiment of FIGS. 3 and 4, the number of teeth on the fixed sun gear 72 is $n$ and the number of teeth on the rotary sun gear 74 is $n - 4$. The profile of the sun gear 74 is different from the profile of the sun gear 72 because each of the planet pinions 75–78 meshes simultaneously with both sun gears. The pitch circles of both sun gears are identical but the spacing of teeth on the sun gear 74 is different from that of teeth on the sun gear 72. This is due to the fact that the profile of each planet pinion is constant from the one to the other axial end thereof. The number of teeth on the sun gears 72, 74 is a whole multiple of the number of planet pinions. Thus, $n$ (the number of teeth on the fixedly mounted sun gear 72) equals $4m$ wherein $m$ is a whole number.

An advantage of the motor which is shown in FIGS. 3 and 4 is that the quantity of leak fluid is minimal because the number of bearing members (covers 67, 68) is only half the minimum number of bearing members in the motor of FIGS. 1 and 2. This is due to the fact that each of the planet pinions 75–78 meshes with both sun gears and that the sun gears 72, 74 are in sealing contact with each other. Moreover, such construction results in a considerable reduction of the overall length of the motor, as considered in the axial direction of the output shaft 69. If the motor comprises a relatively large number of planet pinions (e.g., four, as shown in FIG. 4), the input volume is high and this enables the motor to furnish a high output torque.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. In a gear type fluid power motor, a combination comprising a housing; a rotor in said housing; an output member rotatably mounted in said housing; a plurality of groups of mating external gears in said housing, including a first group having a fixed first sun gear coaxial with said rotor and at least one first planet gear meshing with said sun gear and rotatable in said rotor whereby said rotor rotates when said planet gear rolls along said sun gear, and a second group having a rotary second sun gear coaxial with said first sun gear and arranged to transmit torque to said output member and at least one second planet gear, said second planet gear being rotatable in said rotor with said first planet gear and meshing with said second sun gear; bearing means provided in said rotor for said gears; a supporting member rigid with said housing and rotatably supporting said rotor, said supporting member having first passages for admission of pressurized fluid and second passages for evacuation of spent fluid, said rotor having third passages communicating with said first passages and arranged to normally direct pressurized fluid against the teeth of said first and second planet gears to thereby effect a rolling movement of said first planet gear along the associated sun gear with attendant rotation of said rotor in said housing, said rotor further having fourth passages communicating with said second passages and arranged to receive fluid which is supplied by said third passages and has passed through the tooth spaces of said first planet gear; and valve means activatable to regulate the flow of pressurized fluid in said third passages to at least one of said planet gears.

2. A combination as defined in claim 1, wherein said rotor comprises a hollow receiving member for said groups and said bearing means, said receiving member having two open ends and said rotor further comprising two covers adjacent to said open ends and secured to said receiving member.

3. A combination as defined in claim 1, wherein said housing comprises an end wall and said output member is journalled in said bearing means and said end wall.

4. A combination as defined in claim 1, said rotor being rotatably mounted on said supporting member and said output member.

5. A combination as defined in claim 1, said supporting member having a portion extending into said housing, said first sun gear being non-rotatably mounted on said portion of said supporting member.

6. A combination as defined in claim 1, wherein said housing comprises an end wall said supporting member being rigid with said end wall and extending into said housing, said rotor being rotatable on said supporting member.

7. A combination as defined in claim 1, wherein said groups of gears include at least one gear which is eccentric to said rotor and said rotor comprises at least one counterweight which balances the mass of said rotor during rotation thereof.

8. A combination as defined in claim 1, wherein said valve means comprises a valve member which is movably mounted in said supporting member.

9. A combination as defined in claim 8, wherein said valve member is movable between a first position is which all of said third passages receive pressurized fluid from said first passages and a second position in which the third passages for one of said planet gears are short-circuited to thus prevent the flow of pressurized fluid against the teeth of the respective planet gear.

10. A combination as defined in claim 1, wherein each of said first and second groups comprises a single planet gear.

11. A combination as defined in claim 10, wherein said bearing means comprises a pair of eight-shaped bearing members flanking the gears of one of said groups, each gear of said one group having two coaxial stubs one of which extends into one and the other of which extends into the other of said bearing members.

12. A combination as defined in claim 10, wherein each gear of at least one of said groups has two coaxial stubs and said bearing means comprises four bearing sleeves, one for each of said stubs.

13. In a gear type fluid power motor, a combination comprising a housing comprising a hollow main body portion and two end walls adjacent to the ends of and rigid with said main body portion; a rotor in said housing and comprising a hollow gear receiving member having two open ends, two covers adjacent to said open ends and rotatable with said receiving member; an output member rotatably mounted in said housing; a plurality of groups of mating external gears in said housing, including a first group having a fixed first sun gear coaxial with said rotor and at least one first planet gear meshing with said sun gear and rotatable in said rotor whereby said rotor rotates when said planet gear rolls along said sun gear, and a second group having a rotary second sun gear coaxial with said first sun gear and arranged to transmit torque to said output member and at least one second planet gear, said second planet gear being rotatable in said rotor with said first planet gear and meshing with said second sun gear each of said gears having an end face adjacent to one side of one of said covers and each of said covers having another side adjacent to one of said end walls; bearing means in said rotor for said gears; and means for establishing fluid pressure fields between said end walls and the respective covers to thereby urge said one side of each cover against said end faces of the respective gears.

14. A combination as defined in claim 13, wherein said covers constitute the bearing means for said planet gears.

15. A combination as defined in claim 13, wherein said first planet gear is integral with said second planet gear.

16. A combination as defined in claim 13, further comprising a supporting member rigid with one of said end walls, said output member being rotatable in said supporting member and in the other of said end walls.

17. A combination as defined in claim 13, wherein at least one of said groups comprises a plurality of planet gears.

18. A combination as defined in claim 17, wherein said plurality of planet gears include two planet gears which are mirror symmetrical to each other with respect to the axis of the corresponding sun gear.

19. A combination as defined in claim 13, wherein the number of teeth on said first sun gear exceeds the number of teeth on said second sun gear.

20. A combination as defined in claim 19, wherein the number of planet pinions in each of said groups equals the difference between the number of teeth on said first sun gear and the number of teeth on said second sun gear.

* * * * *